US009580277B2

(12) United States Patent
Metsänen et al.

(10) Patent No.: US 9,580,277 B2
(45) Date of Patent: Feb. 28, 2017

(54) ELEVATOR CAR SUSPENSION

(71) Applicants: Aki Metsänen, Hyvinkaa (FI); Teuvo Väntänen, Hyvinkaa (FI)

(72) Inventors: Aki Metsänen, Hyvinkaa (FI); Teuvo Väntänen, Hyvinkaa (FI)

(73) Assignee: KONE CORPORATION, Helsinki (FI)

( * ) Notice: Subject to any disclaimer, the term of this patent is extended or adjusted under 35 U.S.C. 154(b) by 702 days.

(21) Appl. No.: 13/890,757

(22) Filed: May 9, 2013

(65) Prior Publication Data

US 2013/0248295 A1 Sep. 26, 2013

Related U.S. Application Data

(63) Continuation of application No. PCT/FI2011/000046, filed on Nov. 10, 2011.

(30) Foreign Application Priority Data

Nov. 30, 2010 (FI) ..... 20106257

(51) Int. Cl.

| | |
|---|---|
| ***B66B 11/02*** | (2006.01) |
| ***B66B 7/06*** | (2006.01) |
| *B66B 11/08* | (2006.01) |

(52) U.S. Cl.

CPC ..... *B66B 7/06* (2013.01); *B66B 11/0206* (2013.01); *B66B 11/0273* (2013.01)

(58) Field of Classification Search

CPC B66B 11/0273; B66B 11/0206; B66B 11/008

(Continued)

(56) References Cited

U.S. PATENT DOCUMENTS 5,199,529 A * 4/1993 Salmon ..... B66B 11/0273 187/401
5,613,667 A * 3/1997 Ho ..... B66B 11/0273 248/621

(Continued)

FOREIGN PATENT DOCUMENTS

EP 1364905 A1 11/2003
JP 55-117466 U 8/1980

(Continued)

OTHER PUBLICATIONS

AIPN Machine Translation, JP2001-247278 A, Jun. 26, 2016, pp. 1-10.*

(Continued)

*Primary Examiner* — William A Rivera
*Assistant Examiner* — Stefan Kruer
(74) *Attorney, Agent, or Firm* — Harness & Dickey & Pierce, P.L.C.

(57) ABSTRACT

An elevator in which hoisting ropes pass under first and second diverting pulleys, in which a suspension device crosses a line between guide rails. The first and second diverting pulleys may be mounted on the suspension device such that the first and second diverting pulleys may be on a first side and a second side, respectively, in which the sides being opposite, of the line between the guide rails. A frame of the elevator car may be mounted on the suspension device which is supported by a first suspension point and a second suspension point. The first suspension point and the second suspension point may be at a horizontal distance from each other and on opposite sides of each other, and that the first and second suspension points may be on a line between the guide rails or on a line parallel with the guide rails.

17 Claims, 5 Drawing Sheets

(58) Field of Classification Search
USPC ..... 187/266
See application file for complete search history.

(56) References Cited

U.S. PATENT DOCUMENTS

| | | | | |
|---|---|---|---|---|
| 5,957,243 | A | 9/1999 | Root et al. | |
| 6,443,266 | B2 * | 9/2002 | Murakami | B66B 11/0273 187/401 |
| 2001/0047908 | A1 | 12/2001 | Murakami et al. | |
| 2004/0173411 | A1 * | 9/2004 | Silberhorn | B66B 11/0226 187/277 |
| 2008/0289908 | A1 * | 11/2008 | Murao | B66B 11/0206 187/266 |

FOREIGN PATENT DOCUMENTS

| | | | | | |
|---|---|---|---|---|---|
| JP | 56-055281 | U | | 5/1981 | |
| JP | 2001122564 | A | * | 5/2001 | B66B 11/0213 |
| JP | 2001247278 | A | * | 9/2001 | B66B 11/0273 |
| JP | 2001247278 | A | | 9/2001 | |
| JP | 2009155087 | A | * | 7/2009 | B66B 7/08 |

OTHER PUBLICATIONS

International Search Report PCT/ISA/210 for PCT/FI2011/000046 dated Jan. 19, 2012.
Written Opinion PCT/ISA/237 for for PCT/F12011/000046 dated Jan. 19, 2012.
Finnish Search Report for Finnish Application No. 20106257 dated Jul. 13, 2011.

* cited by examiner

ELEVATOR CAR SUSPENSION

This application is a continuation of PCT International Application No. PCT/FI2011/000046 which has an International filing date of Nov. 10, 2011, and which claims priority to Finnish patent application number 20106257 filed Nov. 30, 2010.

FIELD

Example embodiments relate to an elevator, more particularly an elevator applicable to the transporting of people and/or of freight.

BACKGROUND

In prior-art elevators, in which the elevator car is suspended on hoisting roping with 2:1 suspension ratio, the hoisting roping can be led to travel to the car and back from the car upwards at a desired distance from the center point of the elevator car if the rope is led to pass under diverting pulleys that are at a horizontal distance from each other and are in connection with the elevator car, via which diverting pulleys the elevator car is supported in the vertical direction with the hoisting roping. With this arrangement the freedom for placement of the traction sheave and of the rest of the machinery can be increased. In thus this way, for example, placement of the traction sheave in the center of the elevator hoistway can be avoided and the traction sheave can be placed very close to a wall of the elevator hoistway. The diverting pulleys have conventionally been mounted in a manner that allows rotation on a rigid suspension means, on which the frame of the elevator car is for its part mounted. The layout of the elevator is affected by a number of factors, such as the placement of the traction sheave, guide rails, counterweight and door openings of the elevator. It can be necessary, for one reason or another, to dispose said suspension means at an angle. More particularly, if it is a question of suspension in which said suspension means is on the bottom part of the car, the hoisting roping travels on the sides of the elevator car and it is not advantageous to dispose the door openings of the elevator car on those sides. On the other hand, it is advantageous to dispose the guide rails of the car, guided by which the elevator car travels, on these opposite sides. In these types of solutions, it is advantageous e.g. for increasing the centricity of the suspension, to configure the suspension means to cross the line between the guide rails at an angle such that the diverting pulleys mounted on it are disposed on opposite sides of the line between the guide rails, such that also the line between the diverting pulleys crosses the line between the guide rails at an angle. The frame of the elevator car is mounted on a suspension means for being supported by the suspension points comprised in the suspension means, on its top surface, which suspension points are on a line between the diverting pulleys, either at the center of the suspension means or at the ends of the suspension means. A problem in the solutions has been the production of undesirable torques in the frame of the car, the results of which has been inter alia uneven wearing of the guide shoes and the transmission of noise excitations to the car. Now it has been noticed that each suspension point of a suspension means crossing the guide rail line at an angle produces, with its vertical force component, local torque in the sling of the car, because the suspension point is at a distance from the guide rail line in the depth direction of the car. One consequence is an unnecessary horizontal force pair forming in the top guide shoe and bottom guide shoe, which has been manifested as said problems.

SUMMARY

Example embodiments are to eliminate, among others, said drawbacks of prior-art solutions. More particularly, example embodiments are to produce an elevator wherein undesirable torque acting on the frame of the elevator car of which elevator can be reduced.

Example embodiments are based on a concept of arranging the frame of an elevator car for being supported by a suspension means disposed to be of a skewed type such that the frame of the elevator car is mounted on the suspension means for being supported by the first suspension point and the second suspension point of the suspension means, which first suspension point and second suspension point are at a horizontal distance from each other and on opposite sides to each other of a line between the first and second diverting pulley. These first and second suspension points are on a line between the guide rails or on a line parallel with it. One advantage in this case is that the forces produced in the suspension points that are in connection with the structure of the suspension means, more particularly with its support structure, such as with a support beam, produce torsion force components in the support structure of the suspension means, which torsion force components are of opposite directions and the torsion only remains as an internal stress of said structure. In this case also the distances of the suspension points from the guide rail line are such that the problematic forces asymmetrically torsioning the frame are minor, and the force pairs loading the guide shoes do not develop to a problematic extent, so that good ride comfort is retained, and wearing of the guide shoes is less than before and/or more even than before.

In an example embodiment, the elevator comprises an elevator car, which elevator car comprises a frame and an inside space; and a first and a second car guide rail, which are on a first and a second side of the elevator car, said sides being opposite, and controlled by which car guide rails the elevator car is arranged to move; and a rigid suspension means, on which the frame of the elevator car is mounted; and a first and a second diverting pulley, which are mounted in a manner that allows rotation on said suspension means; and hoisting roping, on which the elevator car is suspended; and in which elevator said hoisting roping passes under said first and second diverting pulley; and which suspension means crosses a line between the guide rails; and which first and second diverting pulley are mounted on the suspension means such that they are disposed on a first side A and a second side B, said sides being opposite, of the line between the guide rails. The frame of the elevator car is mounted on a suspension means for being supported by the first suspension point and the second suspension point comprised in the suspension means, which first suspension point and second suspension point are at a horizontal distance from each other and on opposite sides to each other of the line BP between the first and second diverting pulley; and that said first suspension point is in the proximity of the first diverting pulley; and that said second suspension point is in the proximity of the second diverting pulley; and that said first and second suspension point are on a line (BG) between the guide rails or on a line parallel with it. In this way said advantages are achieved.

In another example embodiment, the frame is mounted non-rigidly on the first and second suspension point. In this way the direct conducting of car torsion to the diverting pulleys is avoided and/or vibration/sound-damping benefits are achieved.

In another example embodiment, the suspension means comprises a first suspension area, which contains said first suspension point, and a second suspension area, which contains said second suspension point, said suspension areas being separate to each other.

In another example embodiment, the suspension means comprises a first suspension area, the resultant point of the supporting forces of which is at least essentially said first suspension point, and a second suspension area, the resultant point of the supporting forces of which is at least essentially said second suspension point.

In another example embodiment, the frame of the elevator car is additionally mounted for being supported by the third suspension point comprised in the suspension means, which third suspension point is, in the direction of the line between the guide rails, between the first suspension point and the second suspension point. It is preferably at, or in the immediate proximity of, the crossing point of the line between the guide rails and the line between the diverting pulleys. It can also be disposed on the second side B of the line between the guide rails.

In another example embodiment, the frame of the elevator car is additionally mounted for being supported by the third suspension point comprised in the suspension means, which third suspension point is on the same line as the first and second suspension point.

In another example embodiment, said suspension points are preferably on a line which is the between the guide rail line and the center point of the elevator car. In this way the centricity of the suspension is still reasonable and the guide shoe forces are not very great.

In another example embodiment, said first and second, and also possibly the third, suspension point are on a line that is parallel with the line between the guide rails, which line is at a horizontal distance of at the most 10 cm from the line between the guide rails. One advantage is small torsion and small guide shoe forces.

In another example embodiment, the center of mass of the elevator car frame is adjusted at least essentially onto the same line as said suspension points, preferably at most 50 mm from said line. One further advantage is reduced torsion and reduced guide shoe forces. This can be done e.g. by means of the weight of elevator components (e.g. of the door operator), e.g. by adding heavy elevator components or ballast weights to the side of the line of suspension points that is on the opposite side to the center point of the car.

In another example embodiment, the suspension means comprises a third suspension area, which contains said third suspension point. The third suspension area is separate from and at a distance from the first and second suspension area. In this way the suspension can be distributed more evenly while still achieving said advantages. In this way also the balance of the suspension means can be increased.

In another example embodiment, the suspension means comprises a third suspension area, the resultant point of the supporting forces of which is said third suspension point.

In another example embodiment, said first and second suspension area together essentially support said frame in the vertical direction, preferably supporting at least one-half, preferably most of the weight of the frame of the elevator car, preferably the whole weight of the frame of the elevator car.

In another example embodiment, said first, second and possibly also said third suspension area together essentially support said frame in the vertical direction, preferably supporting at least one-half, preferably most of the weight of the frame of the elevator car, preferably the whole weight of the frame of the elevator car.

In another example embodiment, the frame is mounted non-rigidly on the first and second suspension point with a means, which is a vibration damping means. Likewise the frame is mounted non-rigidly with a vibration damping means on the third suspension point.

In another example embodiment, the frame is mounted non-rigidly on the first suspension point with a deformable member between the suspension point in question and the frame and on the second suspension point with a deformable member between the suspension point in question and the frame.

In another example embodiment, the frame is mounted non-rigidly on said third suspension point, preferably with a deformable member between the suspension point in question and the frame.

In another example embodiment, each said suspension point/suspension area supports the frame via a deformable member.

In another example embodiment, said deformable member is arranged to allow relative vertical and/or lateral movement between the suspension means and the frame, preferably at least vertical movement, which said movement is a displacement in relation to each other of a suspension point and a detent point comprised in the frame resting on said suspension point.

In another example embodiment, said deformable member is an elastically deformable elastic member, (for forming a flexible support between the frame of the elevator car and a support element), preferably an elastomer piece, e.g. a rubber piece.

In another example embodiment, in the proximity of each said deformable member are also means for limiting the relative movement enabled by said deformable member, which means for limiting the relative movement comprise a detent surface/detent surfaces, which prevent(s) relative movement past a certain position, preferably the frame and suspension means are additionally connected with means for limiting said relative movement.

In another example embodiment, the frame and the suspension means are connected with a mechanical bolt fixing, in addition to said deformable member, in the proximity of each said first and second suspension point, which fixing creates limits in the lateral direction and/or in the vertical direction for said relative movement.

In another example embodiment, the frame rests on top of said first and second suspension point, and on top of the third suspension point, if one exists.

In another example embodiment, the suspension means comprises an upward-facing surface which comprises said first suspension area, and an upward-facing surface which comprises said second suspension area.

In another example embodiment, the suspension means, more particularly the support structure crossing the line between the guide rails comprised in it, comprises an upward-facing surface which comprises said third suspension area.

In another example embodiment, the suspension means comprises a support structure, which is preferably a support beam, crossing the line between the guide rails, which support structure connects in a fixed manner to each other the first support part, which extends to at least said line between the guide rails or to a line parallel with it, which first support part comprises said first suspension point, and the second support part, which extends to at least said line between the guide rails or to a line parallel with it, which second support part comprises said second suspension point. In this way a simple, inexpensive, rigid entity and a torque arm at the point of the suspension points are achieved. In this way the placement of the suspension points, inter alia, can be selected more freely.

In another example embodiment, said support beam is elongated in the horizontal direction, more particularly in the direction of the line between the diverting pulleys, and comprises a first end, to which said first diverting pulley is fixed in a manner that allows rotation, and a second end, to which said second diverting pulley is fixed in a manner that allows rotation.

In another example embodiment, said support structure comprises said third suspension point. Thus the construction is simple and durable.

In another example embodiment, said horizontal distance of the support points is at least one-quarter, more preferably at least one-third, most preferably at least most of the distance between said guide rails in the direction of the guide rail line. Thus the suspension is near the edges of the car and a good lateral balance is achieved. Likewise it is easier to bring the suspension points to the desired line and the length of the torque arm can be optimized.

In another example embodiment, as viewed from above the line between the diverting pulleys crosses the line between the guide rails at an angle, which is at least 10 degrees and at most 30.

In another example embodiment, the suspension means comprises a support beam elongated in the horizontal direction, which support beam connects said first and second support part to each other in a fixed manner.

In another example embodiment, the suspension means comprises a support beam, which is elongated in the horizontal direction, and comprises a first end, to which said first diverting pulley is fixed, and a second end, to which said second diverting pulley is fixed, and which support beam connects said first and second support part to each other in a fixed manner.

In another example embodiment, said first and second suspension part are connected to said elongated support beam at a distance from each other in the longitudinal direction of the support beam.

In another example embodiment, said first and second support part are connected to said elongated support beam at a distance from each other in the longitudinal direction of the support beam, and that they extend outwards from said support beam in opposite lateral directions, preferably either at a right angle with respect to the support beam or at a right angle with respect to the line between the guide rails.

In another example embodiment, the first support part is a support part extending from the first side of the line between the guide rails to at least the line between the guide rails or over it, and the second support part is a support part extending from the second side of the line between the guide rails to at least the line between the guide rails or over it. In this way the support points can be disposed as desired in relation to the guide rail line regardless of the angle of the suspension means and for advantageous internal torsion of the suspension means.

In another example embodiment, said suspension means is on the bottom part of the elevator car and the hoisting roping travels to the first diverting pulley from beside the first side of the elevator car, on the side of which side is the first car guide rail, and travels onwards below the inside space of the car to the second diverting pulley, from where onwards upwards from beside the second side of the elevator car, on the side of which side is the second car guide rail. In this way a compact layout is achieved.

In another example embodiment, the hoisting roping travels downwards to a first diverting pulley on the first side A of the line between the guide rails and onwards to a second diverting pulley, and that the hoisting ropes between the first and second diverting pulley cross the line between the guide rails, and from which second diverting pulley the hoisting roping travels upwards on the second side B of the line between the guide rails.

In another example embodiment, the rim of said first diverting pulley extends to outside the vertical projection of the elevator car on the first side of the elevator car, and the rim of said second diverting pulley extends to outside the vertical projection of the elevator car on the second side of the elevator car.

In another example embodiment, the elevator comprises a counterweight, which is arranged to travel on the side of the first side of the elevator car, on the side of which side is the first car guide rail.

In another example embodiment, said support means is on the bottom part of the elevator car and the hoisting roping travels from above downwards to the first diverting pulley from beside the first side of the elevator car, on the side of which first side is the first car guide rail, and travels onwards below the inside space of the car to the second diverting pulley, from where onwards upwards from beside the second side of the elevator car, on the side of which side is the second car guide rail, and that the elevator comprises a counterweight, which is arranged to travel on the side of the first side of the elevator car, on the side of which side is the first car guide rail, and that said hoisting roping travels from above downwards to a first diverting pulley on the opposite side of the line between the guide rails to said counterweight. Thus a compact layout for an elevator that behaves advantageously is achieved.

In another example embodiment, the distance of the first diverting pulley in the lateral direction, which lateral direction is at a right angle to the line between the guide rails, from the first guide rail is smaller than the distance of the second diverting pulley in said lateral direction from the second guide rail. Thus the centricity of the suspension can be increased.

In another example embodiment, the distance of the line between the guide rails in said lateral direction from the side parallel with the line between the guide rails of an elevator car is smaller on the first side A of the line between the guide rails than on the second side B of the line between the guide rails.

In another example embodiment, the elevator comprises a counterweight, which is arranged to travel on the second side B of the line between the guide rails. Thus a compact layout for an elevator that behaves advantageously is achieved.

In another example embodiment, a support structure, more particularly the support beam of it, connects said diverting pulleys rigidly to each other.

In another example embodiment, the elevator car is suspended with hoisting roping passing below the elevator car.

In another example embodiment, the first and the second support points are below the level of the centers of rotation of the diverting pulleys; thus the suspension means is self-centering.

Example embodiments are also presented in the descriptive section and in the drawings of the present application. Example embodiments can also be defined differently than in the claims presented below. Example embodiments may also consist of several separate inventions, especially if example embodiments are considered in the light of expressions or implicit sub-tasks or from the point of view of advantages or categories of advantages achieved. In this case, some of the attributes contained in the claims below may be superfluous from the point of view of separate inventive concepts. The features of the various example embodiments can be applied within the framework of the basic inventive concept in conjunction with other example embodiments. The features mentioned in conjunction with each said example embodiment can also separately from the features mentioned in conjunction with the other example embodiments form a separate invention, in which case at least some of the features of said basic embodiment can be omitted.

BRIEF DESCRIPTION OF DRAWINGS

In the following, the invention will be described in detail by the aid of some examples of its embodiments with reference to the attached drawings, wherein FIG. 1 diagrammatically presents an elevator according an example embodiment.

DETAILED DESCRIPTION OF EXAMPLE EMBODIMENTS

Figure 1:
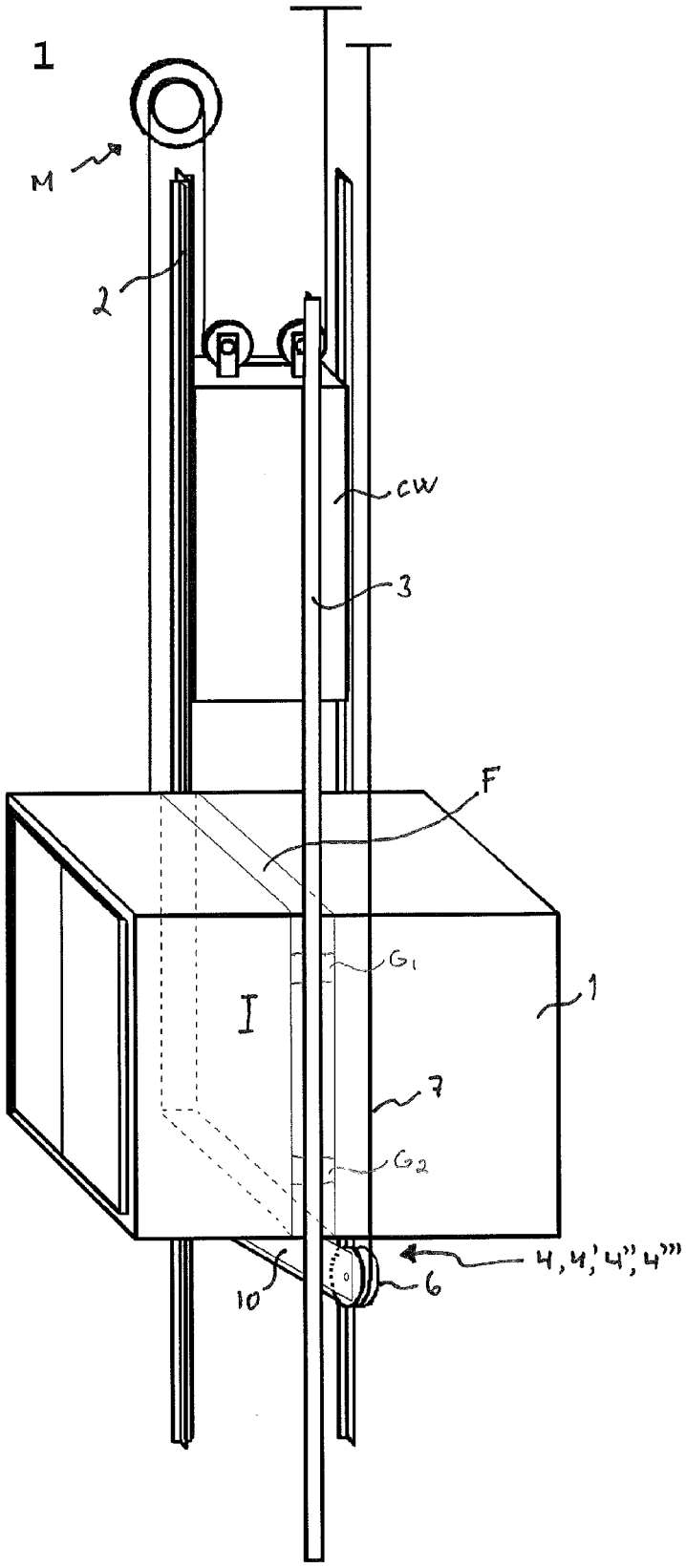

FIG. 1 presents an elevator according to example embodiments, which elevator comprises an elevator car 1 arranged to move in an elevator hoistway S, which elevator car 1 comprises an inside space I, which is bounded by the walls, roof, floor and at least one door panel of the elevator car 1. The elevator car is moved with a hoisting machine M via hoisting roping 7, which hoisting roping comprises one or more hoisting ropes. The elevator comprises a first car guide rail 2 on a first side of the elevator car and a second car guide rail 3 on a second opposite side, guided by which car guide rails the elevator car 1 is arranged to move. For this purpose the elevator car 1 comprises a top guide shoe and a bottom guide shoe traveling guided by a first guide rail 2, as well as a Lop guide shoe and a bottom guide shoe traveling guided by a second guide rail 3 (only the guide shoes C1, G2 on one side presented), which guide shoes can be according to any prior art. The elevator car 1 comprises a frame F, which comprises at least one upper horizontal beam, the vertical beams of a first side and of a second side, and a floor beam system, which are connected to each other such that each of them forms a part of a ring-like frame structure, on the inside of which is the inside space I of the elevator car 1. The frame F of the elevator car is mounted to rest on a rigid suspension means (4,4',4",4'''), and the hoisting roping 7 travels below the first and second diverting pulley (5,6) mounted, in a manner that allows rotation, on said suspension means. The elevator car 1 is thus suspended on the hoisting roping 7 by arranging the frame F of the elevator car 1 to be supported by the hoisting roping 7 via said suspension means and the diverting pulleys mounted on it. The suspension means (4,4',4",4''') crosses the line (BG) between the guide rails (2,3). The first and the second diverting pulley (5,6) are mounted on the suspension means (4,4',4',4''') such that they are disposed on a first side A and on a second side B, said sides being opposite to each other, of the line BG between the guide rails 2,3, so that the line BP between them, i.e. the line from the first diverting pulley 5 to the second 6, as well as the hoisting roping 7 between them, cross the line BG between the guide rails.

The elevator comprises a counterweight, which is arranged to travel on the side of the first side of the elevator car, on the side of which side is the first car guide rail. The lifting function is implemented by suspending both the counterweight and the elevator car with a 2:1 suspension ratio. The hoisting roping 7 travels from its fixing point to the counterweight, passes around the diverting pulleys in connection with it and rises up to the traction sheave, passes over the traction sheave and descends to the elevator car 1 on the first side A of the line BG between the guide rails. Said suspension means 4,4',4",4''' is on the bottom part of the elevator car and the hoisting roping 7 travels from the traction sheave downwards to the first diverting pulley 5 from beside the first side of the elevator car 1, on the side of which side is the first car guide rail 2, and travels onwards below the inside space I of the car to the second diverting pulley 6, from where onwards upwards to its fixing point on the second side B of the line BG between the guide rails from beside the second side of the elevator car 1, on the side of which side is the second car guide rail 3. The hoisting roping travels from the traction sheave downwards to the first diverting pulley on the opposite side of the line BG between the guide rails to that on which said counterweight is. The rim of said first diverting pulley 5 extends to outside the vertical projection of the elevator car 1 on the first side of the elevator car 1, and the rim of said second diverting pulley 6 extends to outside the vertical projection of the elevator car on the second side of the elevator car.

The frame F of the elevator car 1 is mounted on a suspension means (4,4',4",4''') for being supported by the first suspension point (8,8',8",8''') and the second suspension point (9,9',9",9''') comprised in the suspension means, which first suspension point and second suspension point are at a horizontal distance from each other and on opposite sides to each other of a line BP between the first and second diverting pulley 5,6. Said first suspension point (8,8',8",8''') is in the proximity of the first diverting pulley 5, and the second suspension point (9,9',9",9''') is in the proximity of the second diverting pulley 6. Said first and second suspension point are on a line BG between the guide rails 2,3 or on a line parallel with it, in which case they are therefore on the same line as each other, which line is at an angle with respect to the line between the diverting pulleys. A member is preferably between each said suspension point (8,8',8",8''',9,9',9", 9''') and the frame F, via which means the suspension point in question supports the frame F. A preferred structure of the means is presented in more detail in connection with FIG. 3. The means is more particularly such that it enables damping between the suspension point and the frame F and/or enables a small relative movement to occur between them. FIGS. 2*a*-2*c* and 7 present in more detail the most preferred layout options, with which support of the type described above can be implemented. The suspension means (4,4',4",4''') comprises a first suspension area ($A_1$,$A_1$",$A_1$"), which contains said first suspension point (8,8',8",8'''), and a second suspension area ($A_2$,$A_2$',$A_2$"), which contains said second suspension point (9,9',9",9'''), said suspension areas being at a horizontal distance from each other and separate to each other. A structural suspension connection is formed between the supporting structure (4,4',4",4''') and the structure F to be supported, in which connection the supporting force is transmitted from the supporting structure to the structure F to be supported via an area of at least some size. Preferably the resultant point of the supporting forces of the first suspension area ($A_1$,$A_1$',$A_1$") is essentially said first suspension point (8,8',8",8'''), and the resultant point of the supporting forces of the second suspension area ($A_1$,$A_1$',$A_1$") is essentially said second suspension point (9,9',9",9'''). The resultant points during suspension might vary slightly, but with an empty stationary car the tolerance is preferably +−20 mm. More particularly, the suspension is transmitted via an area, of at least some size, in which said suspension point is situated. As presented in the figures the resultant of the supporting forces can be formed in the suspension area. Said first and second suspension area ($A_1$,$A_1$',$A_1$",$A_2$,$A_2$',$A_2$") together essentially support said frame in the vertical direction. The frame F rests on top of said first and second suspension point/suspension area, thus being supported in the vertical direction on these suspension points/suspension areas. Thus the frame exerts a downward compressive force on a suspension point/suspension area, instead of a shearing force. For this purpose the suspension means (4,4',4",4''') comprises an upward-facing surface, which comprises a suspension area ($A_1$,$A_1$',$A_1$"), in which said first suspension point is disposed, and an upward-facing surface, in which said second suspension point ($A_2$,$A_2$',$A_2$") is disposed. As stated above, there can be a member 13 between the frame F and a suspension point, in which case the supporting force is conducted in the vertical direction via the member 13 from the support point to the frame F. The suspension means (4,4',4",4''') is in its structure preferably of a type presented in any of FIGS. 2*a*-7 and comprises a support structure 10 crossing the line BG between the guide rails, which support structure is preferably a support beam, which connects in a fixed manner to each other the first support part 11, which extends to said line, which is the line BG between the guide rails 2,3 or a line parallel with it, from the first side of the line in question, which first support part comprises said first suspension point (8,8',8",8'''), and the second support part 12, which extends to said line, which is the line BG between the guide rails 2,3 or a line parallel with it, from the second side of the line in question, which second support part comprises said second suspension point (9,9',9",9'''). Thus the vertical forces acting on them cause torsions in different directions in relation to the longitudinal axis of the support structure (of the support beam), which torsions at least partly cancel each other out. The support parts are most preferably support arms, which preferably extend at a right angle or at an inclined angle towards the side from said support structure, which is most preferably a support beam, up to the line between the guide rails or even over it. This support beam is elongated in the horizontal direction, more particularly in the direction of the line between the diverting pulleys, and comprises a first end, to which said first diverting pulley 5 is fixed in a manner that allows rotation, and a second end, to which said second diverting pulley 6 is fixed in a manner that allows rotation. Said first and second support part are rigidly fixed to said elongated support beam at a distance from each other in the longitudinal direction of the support beam, and for achieving advantageous torsion symmetry, in relation to the longitudinal axis of the beam they extend away from said support beam in opposite lateral directions.

Said first and the second support point are preferably near the guide rails 2,3 in the direction of the guide rail line, in which case the suspension can be arranged close to the edge of the car and in this way the preferred force distribution can be achieved in the frame of the car, because near the edge the frame can be simply formed to be rigid. The horizontal distance of the support points in the direction of the line BG between the guide rails is preferably at least one-quarter, more preferably at least one-third, most preferably at least most of the distance between said guide rails 2,3.

In addition to said support points, there can be other support points. As well as said first and second suspension point the frame F of the elevator car 1 can be, but not necessarily is, also mounted on a suspension means (4,4', 4",4''') for being supported by a third suspension point (x,x',x",x''',x'''') comprised in the suspension means, which third suspension point is, in the direction of the line BG between the guide rails, between the first and the second suspension point. For this purpose the suspension means (4,4',4",4''') can comprise a third suspension area ($A_3$,$A_3$', $A_3$"), which contains said third suspension point (x,x'x",x'''). The third suspension area ($A_3$,$A_3$',$A_3$") is separate and at a distance from the first and second suspension area. The third suspension point (x,x'x",x''') is most preferably on the same line as the first and second suspension point. Preferably the resultant point of the supporting forces of the third suspension area is said third suspension point (x,x'x",x'''). It is preferably disposed at, or in the immediate proximity of, the crossing point of the line BG between the guide rails and the line BP between the diverting pulleys. The third suspension point/suspension area is not necessary, and that being the case is marked with a dashed line. The suspension of it can be arranged preferably in exactly the same way as at the point of the first and second suspension point. Between the third suspension point (x,x'x",x''') and the detent point/area of the frame F there can thus also be, in a corresponding manner, a member 13, which is a damping means and/or a deformable member enabling relative movement of the frame F and the suspension means. The member 13 can, however, if so desired, even be omitted even if the means of the type in question were in the other said points. The means of the third suspension point can also enable relative movement at its point in a different way than other said points, preferably however at least relative movement in the vertical direction.

Figure 2A:
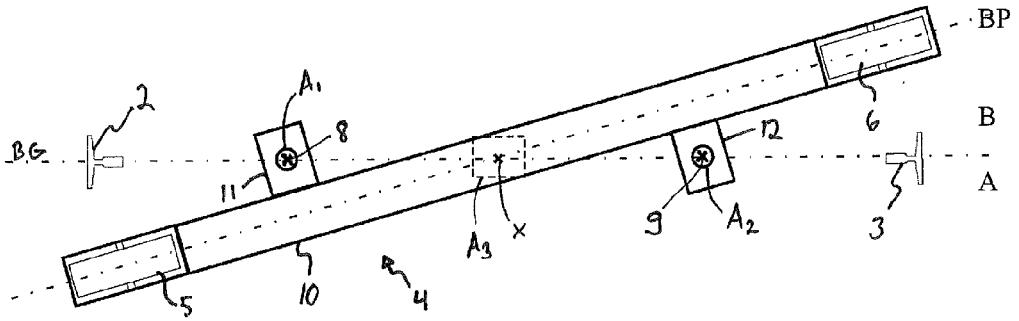
FIGS. 2*a*-2*c* present a top view of alternative preferred layouts of a suspension means, the guide rails and the frame of an elevator according to an example embodiment.
Figure 2B:
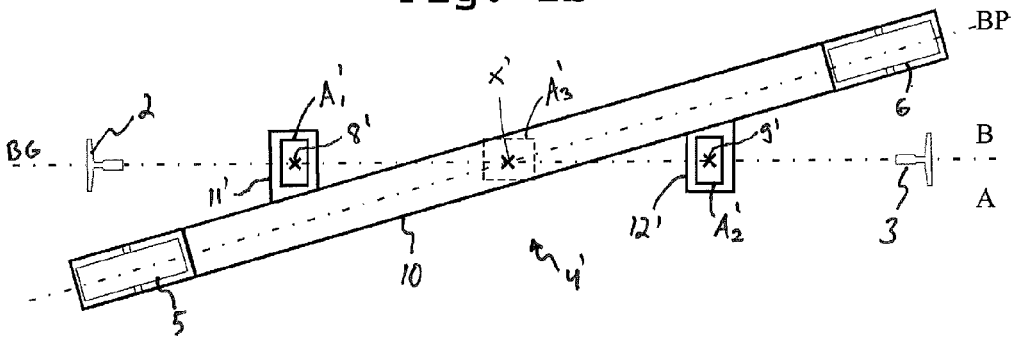
Figure 2C:
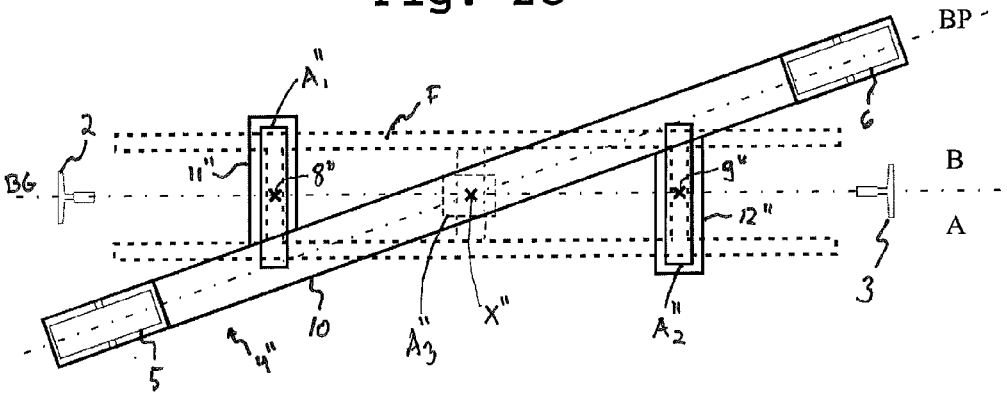

FIGS. 2*a*-2*c* present a top view of the placement of a suspension means in relation to the guide rails and in relation to the frame. The frame is not marked in all the figures, but the frame comprises matching detent points/areas for the suspension points/areas presented. In the figures, each suspension point is in a suspension area, which in the figure surrounds the point in question. This area describes the preferred area that bears the weight of the frame, and it is advantageous to arrange a member 13 of the shape of this area between the suspension means and the frame, the structure of which member 13 is described, inter alia, in connection with FIG. 3. If it is not desired to utilize a member 13, the frame can rest directly on the suspension points in question and on their presented areas. In the solution of FIG. 2*a* the first and the second support part 11, 12 extend, as viewed from above, to the side at a right angle with respect to the longitudinal direction of the support beam 10. In the solution of FIGS. 2*b* and 2*c* the first and the second support part extend, as viewed from above, to the side at a right angle with respect to the line BG between the guide rails. As presented in FIGS. 2*a*-2*c*, the first support part 11 comprises a first suspension point (8,8',8",8'"), which is in the proximity of the first diverting pulley 5 and on the line BG between said guide rails 2,3. The second support part 12 comprises said second suspension point 9'", which is in the proximity of the second diverting pulley 6 and on the line (BG) between said guide rails 2,3.

Figure 3:
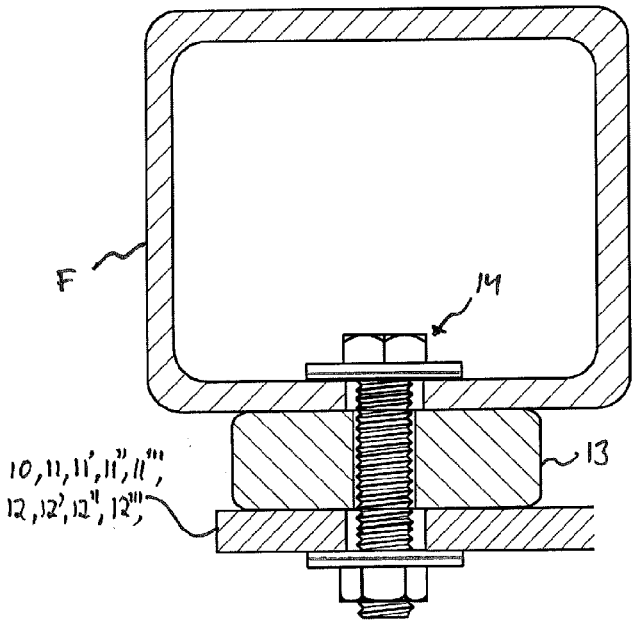
FIG. 3 presents a preferred method to connect the frame of an elevator according to an example embodiment to a suspension point of the suspension means.

FIG. 3 presents a preferred structure as a cross-sectional view at the point of the first and second suspension point (8,8',8",8'",9,9',9",9'") when the frame F is mounted non-rigidly on them. This is done with the member 13. A corresponding support can also be at the point of the third suspension point. This type of member 13 is between each said suspension point and the frame F, and each said suspension point supports the frame F via such a means. Said member 13 is more particularly a member deformable in its shape. It is arranged to allow movement between the suspension means (4,4',4",4'") and the frame F, which movement is a displacement in relation to each other of a suspension point and a detent point comprised in the frame resting on said suspension point. The member 13 presented in the figure is an elastically deformable member, i.e. an elastic member, for forming a flexible support between the frame of the elevator car and a support element. The member 13 is in this case an elastomer piece as presented in the figures, e.g. a rubber piece. The solution has numerous advantages. The means presented enables relative movement in the vertical direction, which is particularly advantageous with the suspension means structure presented because vertical mobility, i.e. the fact that the distance between the support point and the detent point of the frame corresponding to it is able to vary at least moderately, enables the moderate bending acting on the frame, resulting from the non-ideal rigidity of said frame, to be received without bending of the suspension means and therefore also of the rope pulleys. The member 13 presented also enables movement in the lateral direction, which further reduces transmission of the displacements caused by loading variations of the frame structure to the diverting pulleys of the suspension means. When the structure is, as presented, one that moves, transfer of vertical and lateral vibration between the car and the suspension means also decreases. The member 13 thus also functions as a damping member, more particularly if the member 13 is elastically deformable, the damping is effective. The solution of FIG. 3 also presents means 14 for limiting the relative movement enabled by said means, which means comprise a detent surface/detent surfaces, which prevent(s) relative movement past a certain position. More precisely the frame and the suspension means are connected at the point of the elastic member 13 with a bolt fixing, in addition to the elastic member, but since there is a flexible element between the frame and the support means, relative movement is able to occur between them despite the bolt fixing, which fixing creates limits to the flexibility, thus determining the freedom of movement of the frame and the suspension means. The elastic member 13 is in such a state that it allows said relative movement, i.e. the elastic member 13 is not in a fully compressed state. For achieving this as presented, e.g. with a bolt fixing, the bolt fixing does not press the frame very tight against the elastic member, but instead the frame rests at least mainly with its own weight on top of the elastic member. The fixing presented enables limitation of vertical and lateral movement. The fixing can also be of another type, or there would not necessarily need to be a fixing at all. An advantage of a bolt fixing is that vertical and/or lateral limits to relative movement are achieved with it simply. The acoustic bridge of the bolt fixing itself is eliminated in the solution of the figure with a damper, e.g. with a rubber coating or with a separate rubber washer, between the washer and the frame. The insulation can continue to inside the hole presented between the bolt and the frame. An alternative for limiting lateral movement could be shape-lockings between the support means, the elastic member and the frame, with a male-female-type structure preventing lateral movement. Yet another alternative to the solution presented would be if there were another type of deformable member, such as a hinge that allows vertical displacement of the frame and of the support means by the aid of bending, instead of the elastic piece presented.

Figure 4:
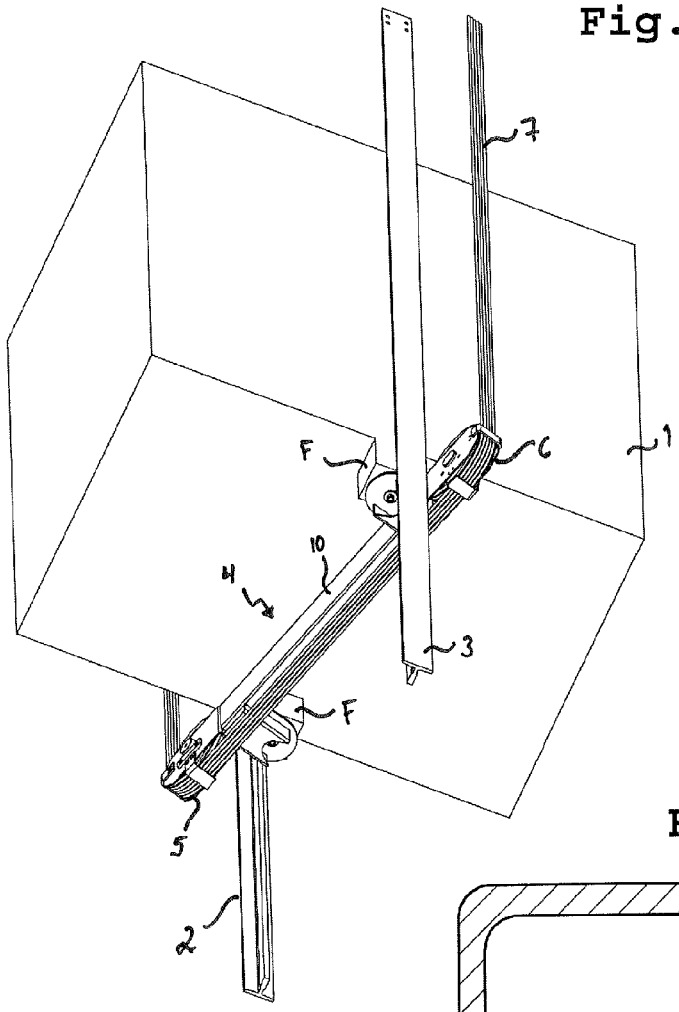
FIG. 4 presents a three-dimensional drawing of a preferred embodiment of an elevator according to an example embodiment.
Figure 5:
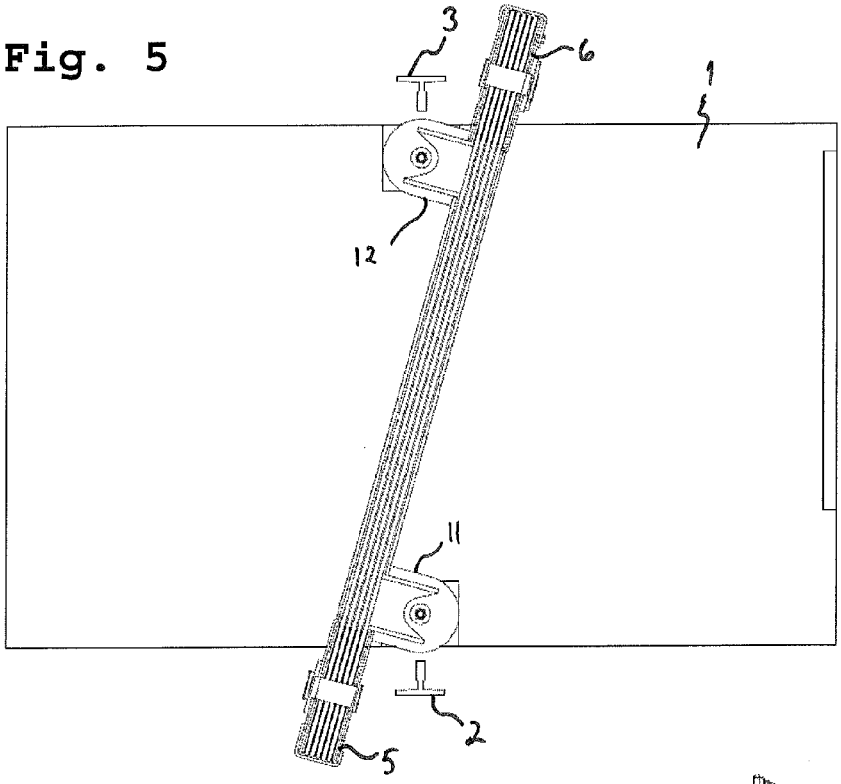
FIG. 5 presents some parts of an elevator according to FIG. 4 as viewed from below.
Figure 6:
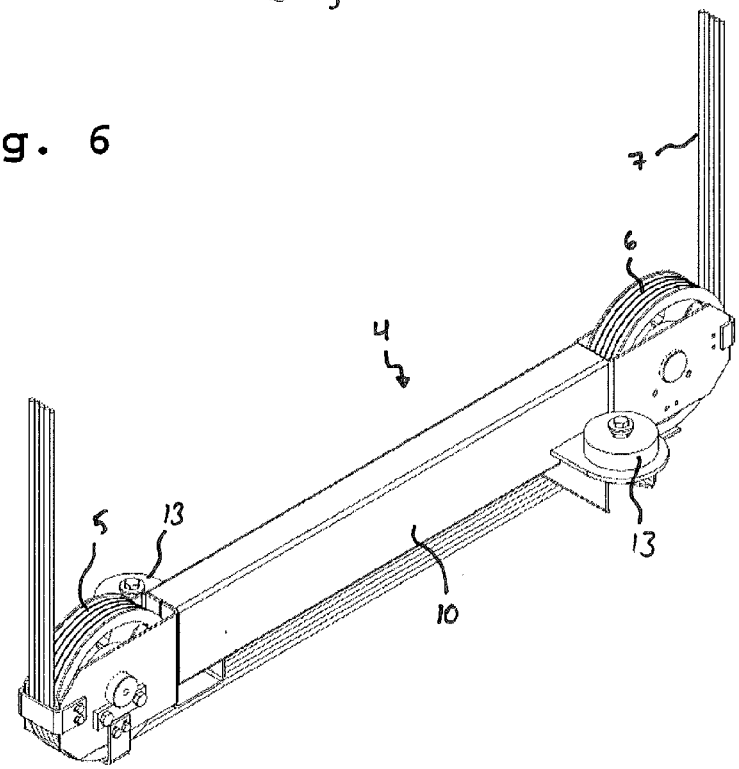
FIG. 6 presents a preferred suspension means of the elevator according to an example embodiment that is presented in the embodiment of FIG. 4, said suspension means being reeved.

FIGS. 4-5 present one implementation method for the solution of FIG. 1, more particularly utilizing the placement of the support points of FIG. 2*a*. FIG. 6 presents a support means on its own. Said first and the second support point are, in the solution according to FIG. 6, below the level of the centers of rotation of the diverting pulleys 5 and 6, as a result of which the suspension means is one that stays in its vertical position stably. For this purpose the frame can comprise frame parts F extending to below the top surface of the support beam of the suspension means, as presented in FIG. 5, which frame parts comprise detent points for a first and a second support point. It is advantageous to utilize this type of vertical placement of the support points also in the other embodiments presented.

Figure 7:
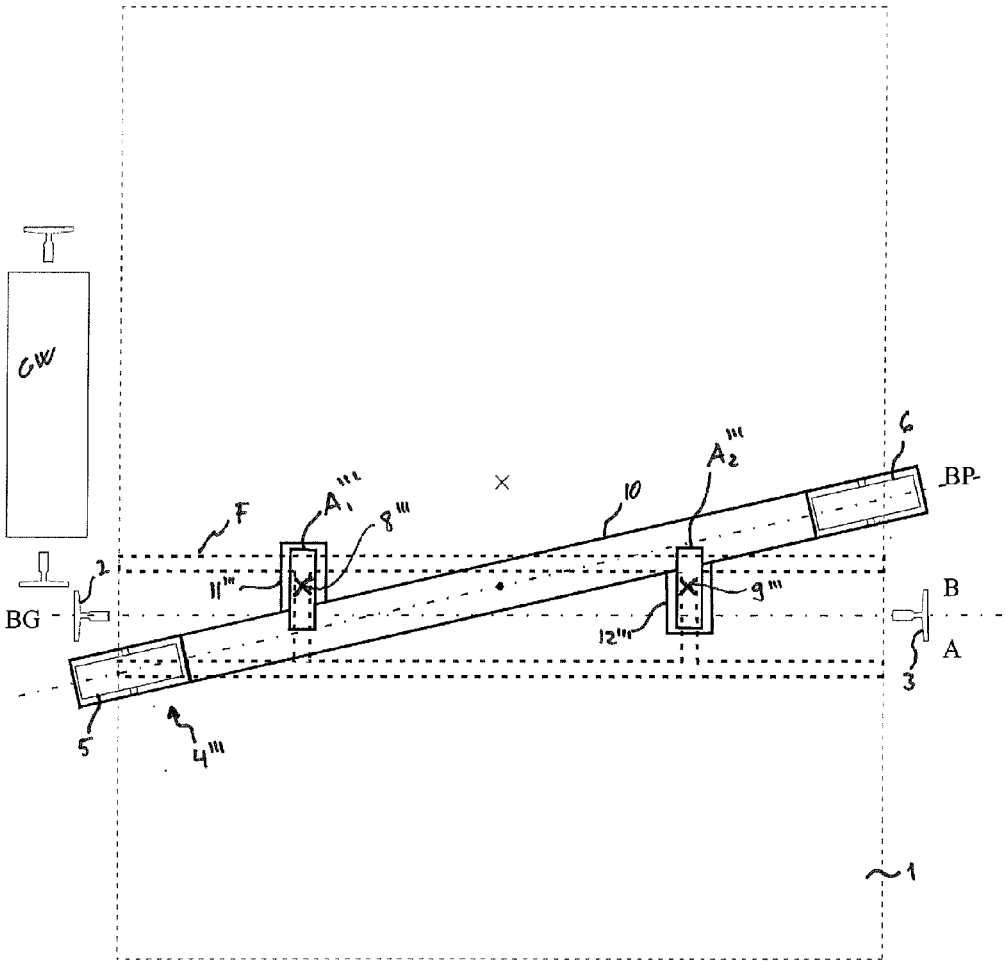
FIG. 7 presents a top view of a preferred layout of the elevator according to an example embodiment that is presented in FIG. 1.

FIG. 7 presents one preferred layout for an elevator according to FIG. 1. In this solution said first and second suspension point are on a line, which is parallel with the line BG between the guide rails (2,3), but which line is at a horizontal distance from it. In the solution the distance of the first diverting pulley 5 in the lateral direction, which lateral direction is at a right angle to the line BG between the guide rails, from the first guide rail 2 is smaller than the distance of the second diverting pulley 6 in said lateral direction from the second guide rail 3. In this way the first diverting pulley can be brought nearer to the traction sheave. On the other hand, in this way the centricity of the suspension of the elevator car can be slightly increased, if it is, for one reason or another, advantageous to situate the guide rail line BG at a distance from the center point of the surface area of the vertical projection of the elevator car, or when, for one reason or another, the center of mass is (e.g. for loading reasons or for other reasons) elsewhere than at the point of the guide rail line. As presented in FIG. 6 the solution is preferably further implemented such that the distance of the line BG between the guide rails (2,3) in said lateral direction from the side (parallel with the line between the guide rails) of the elevator car is smaller on the first side A of the line BG between the guide rails than on the second side B of the line BG between the guide rails. In this way the elevator can be formed in a space-efficient manner to comprise a counterweight, which is arranged to travel on the second side B of the line BG between the guide rails. The figure presents suspension that utilizes placement of the support points of the type of FIG. 2*d*, but said features are also advantageous with other variations in this application, more particularly with those described in FIGS. 2*a*-2*c*. The distance of the first suspension point 8"" in the direction of the line BG between the guide rails from the first guide rail 2 is smaller than the distance of the second suspension point 9"" from the second guide rail 3. The center point of symmetry of the suspension means is also marked in the figure with a dot, which point of symmetry is halfway along the distance between the diverting pulleys on the line between them. Said center point of symmetry is on the second side B of the line between the guide rails, which is how the differences in the distances of the diverting pulleys to the guide rails in their proximity have been achieved. The solution according to FIG. 7 could also comprise a third suspension point/suspension area, which is preferably disposed on the second side B of the line between the guide rails, e.g. as in the type of FIG. 2*c*, and most preferably on the same line as the suspension points 8''' and 9'''.

The first and second suspension area presented, and possibly a third area, if one exists, together essentially support said frame in the vertical direction. They preferably support at least one-half, preferably most of the weight of the frame of the elevator car, preferably the whole weight of the frame of the elevator car (i.e. including also the weight supported by the frame itself). Preferably therefore the suspension areas presented are areas producing at least the most essential suspension, and most preferably the suspension means does not therefore comprise other suspension areas than those presented.

The frame F of the elevator car 1 preferably comprises a ring-like structure, as presented in the preceding. The frame comprises detent points/areas for said suspension points/areas. This is possible to implement in a number of different ways. For example, the frame F can comprise a horizontal beam parallel with the line BG between the guide rails and at the point of it, the bottom surface of which horizontal beam comprises detent points for said suspension points, which can be simply implemented e.g. in the solutions of FIG. 2*a* or 2*b*. Alternatively, the frame F can comprise horizontal beams parallel with the line BG between the guide rails and at a distance from the line BG between the guide rails (as is presented in FIGS. 2*d* and 7), the bottom surfaces of which horizontal beams comprise a detent point for said suspension points. These horizontal beams could have been connected to each other rigidly with cross beams, which alternatively or additionally can comprise detent points/areas of the frame for said suspension points/areas. Yet again alternatively, regardless of the direction of the horizontal beams of the ring-like structure of the frame, the frame F can be formed to comprise support arms fixed to the horizontal beam(s) of the ring-like structure of the frame, which support arms comprise said detent points/areas. These support arms can extend in the vertical direction or in the horizontal direction. All in all the solution is at its most advantageous when the frame F, more particularly the floor beam of it, which connects the vertical beams of the frame, forms an integral part of the floor of the elevator car.

When it is stated in this application that the first suspension point is in the proximity of the first diverting pulley, and the second suspension point is in the proximity of the second diverting pulley, this means in this context that the first support point is, in the direction of the line BP between the diverting pulleys, closer to the first diverting pulley than to the second diverting pulley, and the second support point is, in the direction of the line between the diverting pulleys, closer to the second diverting pulley than to the first diverting pulley.

In an elevator according to the invention the traction sheave of the hoisting machine M is preferably between the path of movement of the elevator car (or of an imagined extension of the path of movement) and a wall of the elevator hoistway. The motor is preferably a flat electric motor, preferably a permanent-magnet motor.

It is obvious to the person skilled in the art that the invention is not limited to the embodiments described above, in which the invention is described using examples, but that many adaptations and different embodiments of the invention are possible within the frameworks of the inventive concept defined by the claims presented below.

The invention claimed is:

1. An elevator, comprising:

an elevator car including a frame and a space therein;

a first car guide rail and a second car guide rail, which are on a first side and a second side, respectively of the elevator car, said first and second sides being opposite, and the elevator car configured to move along said first and second car guide rails; and a suspension device including at least a support beam, wherein the frame of the elevator car is mounted on the suspension device; and a first diverting pulley and a second diverting pulley, which are mounted for rotation on said suspension device; and hoisting ropes, supported by which the elevator car is suspended, wherein:

said hoisting ropes pass under said first and second diverting pulleys, said suspension device crosses an imaginary line of alignment formed between the first and second guide rails, said first and second diverting pulleys are mounted on the suspension device such that said first and second diverting pulleys are aligned on a first side and a second side, respectively, of said first and second car guide rails, the frame of the elevator car is mounted on the suspension device to be supported by a first suspension point and a second suspension point included in the suspension device, said first suspension point and said second suspension point are configured to be at a horizontal distance from each other and on opposite sides in a longitudinal direction of the support beam between the first and second diverting pulleys, and said first and second suspension points include a respective vertical axis, wherein the respective vertical axes are aligned to fall on the imaginary line of alignment.

2. The elevator according to claim 1, wherein the frame is on the first suspension point with a deformable member between the first suspension point, and the frame and on the second suspension point with a deformable member between the second suspension point and the frame.

3. The elevator according to claim 2, wherein the frame is on a third suspension point with a deformable member between a third suspension point and the frame.

4. The elevator according to claim 1, wherein each of said first suspension point and said second suspension point supports the frame via a deformable member.

5. The elevator according to claim 4, wherein said deformable member is arranged to allow relative vertical and/or lateral movement between the suspension device and the frame, which said movement is a displacement in relation to each other of a suspension point and a detent point included in the frame resting on said first and second suspension points.

6. The elevator according to claim 1, wherein the suspension device includes a support structure, crossing the imaginary line between the first and the second guide rails, wherein the support structure further comprises:

a first support part, which is configured to extend to at least said imaginary line between the first and second guide rails, said first support part includes said first suspension point, and a second support part, which is configured to extend to at least said imaginary line between the first and second guide rails, said second support part includes said second suspension point.

7. The elevator according to claim 6, wherein said support structure includes a third suspension point.

8. The elevator according to claim 6, wherein said distance of the first and second support points in a horizontal direction line is at least one-quarter of a distance between said first and second guide rails.

9. The elevator according claim 1, wherein the frame is on the first and second suspension points.

10. The elevator according to claim 1, wherein the suspension device comprises a first suspension area, which contains said first suspension point, and a second suspension area, which contains said second suspension point, said first and second suspension areas being separate to each other.

11. The elevator according to claim 1, wherein the frame of the elevator car is supported by a third suspension point included in the suspension device, and the third suspension point is between the first and second guide rails in a longitudinal direction of the support beam, and between the first suspension point and the second suspension point.

12. The elevator according to claim 1, wherein the frame of the elevator car is supported by the third suspension point included in the suspension device, and the third suspension point is on a same longitudinal direction of the support beam as the first suspension point and the second suspension point.

13. The elevator according to claim 11, wherein the suspension device comprises a third suspension area, which contains a third suspension point.

14. The elevator according to claim 11, wherein said first, second and third suspension points together support said frame in a vertical direction, supporting at least one-half of the weight of the frame of the elevator car.

15. The elevator according to claim 1, wherein the frame is on the first suspension point and the second suspension point with a vibration damping device.

16. The elevator according to claim 1, wherein said deformable member is an elastically deformable member.

17. The elevator according to claim 1, wherein the first and the second support points are below a level of centers of rotation of the first and second diverting pulleys.

* * * * *